United States Patent [19]

Fairbanks et al.

[11] 3,983,819

[45] Oct. 5, 1976

[54] SELF-DESTRUCT DELAY FUZE WITH VOLTAGE-RESPONSIVE SWITCH

[75] Inventors: Bernard Fairbanks, Stanhope; Henrik W. Hansen, Lyndhurst, both of N.J.; Daniel E. Valatka, Denver, Colo.

[73] Assignee: The United States of America as represented by the Secretary of the Army, Washington, D.C.

[22] Filed: May 14, 1975

[21] Appl. No.: 577,498

[52] U.S. Cl. ..... 102/70.2 R; 102/19.2

[51] Int. Cl.[2] ..... F42C 11/00; F42C 15/40

[58] Field of Search ..... 102/70.2 R, 19.2

[56] References Cited

UNITED STATES PATENTS

| | | | |
|---|---|---|---|
| 2,909,122 | 10/1959 | Shoemaker et al. | 102/70.2 R |
| 2,926,610 | 3/1960 | Ruehlemann | 102/70.2 R |
| 2,985,837 | 5/1961 | Ruehlemann et al. | 102/70.2 R |
| 2,998,773 | 9/1961 | Ruehlemann | 102/70.2 R |

*Primary Examiner*—Charles T. Jordan

*Attorney, Agent, or Firm*—Nathan Edelberg; A. Victor Erkkila; Thomas R. Webb

[57] ABSTRACT

An artillery projectile carrying a multiplicity of explosive mines adapted to be deployed from the projectile during flight thereof is provided with self-destruct fuze means for destroying each mine at a predetermined time, e.g., two days, after deployment. This means comprises a battery carried by the projectile connected prior to deployment to a fuze circuit in each mine. Each fuze circuit comprises a first capacitor and parallel resistor forming an RC delay circuit and a second capacitor connected in series with the RC circuit, an electric detonator and a normally-open spin-closed voltage-responsive circuit. The RC circuit is connected to the battery through a normally-open spin-closed switch and a current-limiting resistor. An electrostatic switch is disclosed as an example of the voltage-responsive switch.

10 Claims, 5 Drawing Figures

SELF-DESTRUCT DELAY FUZE WITH VOLTAGE-RESPONSIVE SWITCH

BACKGROUND AND SUMMARY OF THE INVENTION

The present invention relates to a self-destruct fuze for a mine or other explosive device carried by a spin-launched projectile and adapted to be deployed therefrom during flight. The self-destruct fuze is supplemental to the normal fuze for exploding the device on contact with a target, to prevent the deposit of duds which might injure or damage friendly troops or equipment or add to the munitions supply of the enemy.

Since approximately 1968, a high priority military requirement has existed for a system comprising a cluster (e.g. 50) of small, independently-fuzed "scatter" mines launched by a single artillery round and retro-fire-dispersed or deployed therefrom during flight of the round, by a timing means or remote control. It is essential to this concept that each mine be capable of reliable self-destruct at a predetermined time, e.g. about 2 days, after ground impact, if it has not been exploded in the normal manner. Desired characteristics of such a system are:

1. an accuracy of 43 ± 5 hours over a temperature range of −40°F. to +145°F.;
2. a shelf life exceeding ten years;
3. sufficiently rugged that the time delay period is unaffected by artillery delivery or ground impact shock, e.g. 20,000 G's; and
4. a cost when mass produced well under $10.

No technique for meeting all of these requirements has been previously demonstrated. Mechanical approaches such as dashpots and clocks are low cost but fail on accuracy and/or ruggedness. Electronic approaches to date require a battery carried by each mine to continuously power a timing circuit during the 2-day period following deployment from the projectile, and no low-cost battery has been developed for this purpose.

In accordance with the present invention, a single battery is carried by the spin projectile independently of the mines, or other explosive devices carried thereby, and this battery supplies electrical power to each of the mines, during flight through a normally-open, spin-closed switch and a current limiting resistor, to charge two capacitors, one of which forms a part of an RC timing circuit, to a voltage V1. When the mines are dispersed or deployed from the projectile, the RC circuit is isolated from the battery by means of broken connections. When the mines reach the ground and their spin ceases, the RC circuit is disconnected from the mine detonator and the other capacitor, by means of a normally-open, spin-closed, voltage-responsive switch, and the capacitor of the RC circuit begins discharging through its resistor. When the voltage across the RC circuit drops to a value $V_2 = V_1 - V_S$, where $V_S$ is the switching voltage of the voltage-responsive switch, that switch closes and discharges the voltage $V_S$ through the detonator, destroying the mine.

DETAILED DESCRIPTION OF A PREFERRED EMBODIMENT

Figure 2:
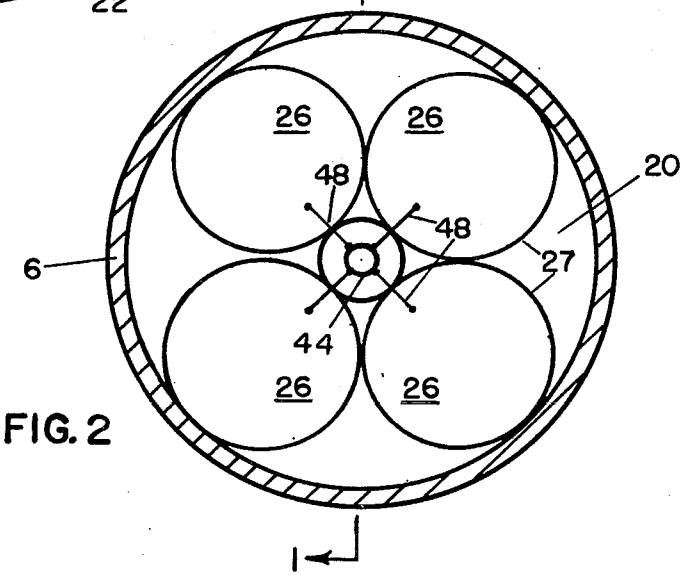
FIG. 2 is a transverse section view taken on line 2—2 of FIG. 1.

For example, the invention is illustrated in the drawing as embodied in an artillery shell or projectile 2, comprising a metal housing 3 including a forward hollow ogive section 4, a hollow cylindrical section 6 threaded to the ogive section at 8, and a base plate 10 held in an annular recess 12 in section 6 by a series of shear pins 14. The space within the shell 2 is divided by two apertured transverse plates 16 and 18 into a mine chamber 20, a propellant chamber 22, and fuze chamber 24. A multiplicity of mines 26, shown schematically in four longitudinal rows with ten cylindrical mines in each row, is stacked in chamber 20 with the outer metal walls 27 of the mines 26 in electrical contact with the section 6, as shown in FIG. 2. The chamber 22 is filled with a propellant charge 28 for expelling the mines 26 from the shell during flight after a given time delay or in response to a signal.

Figure 1:
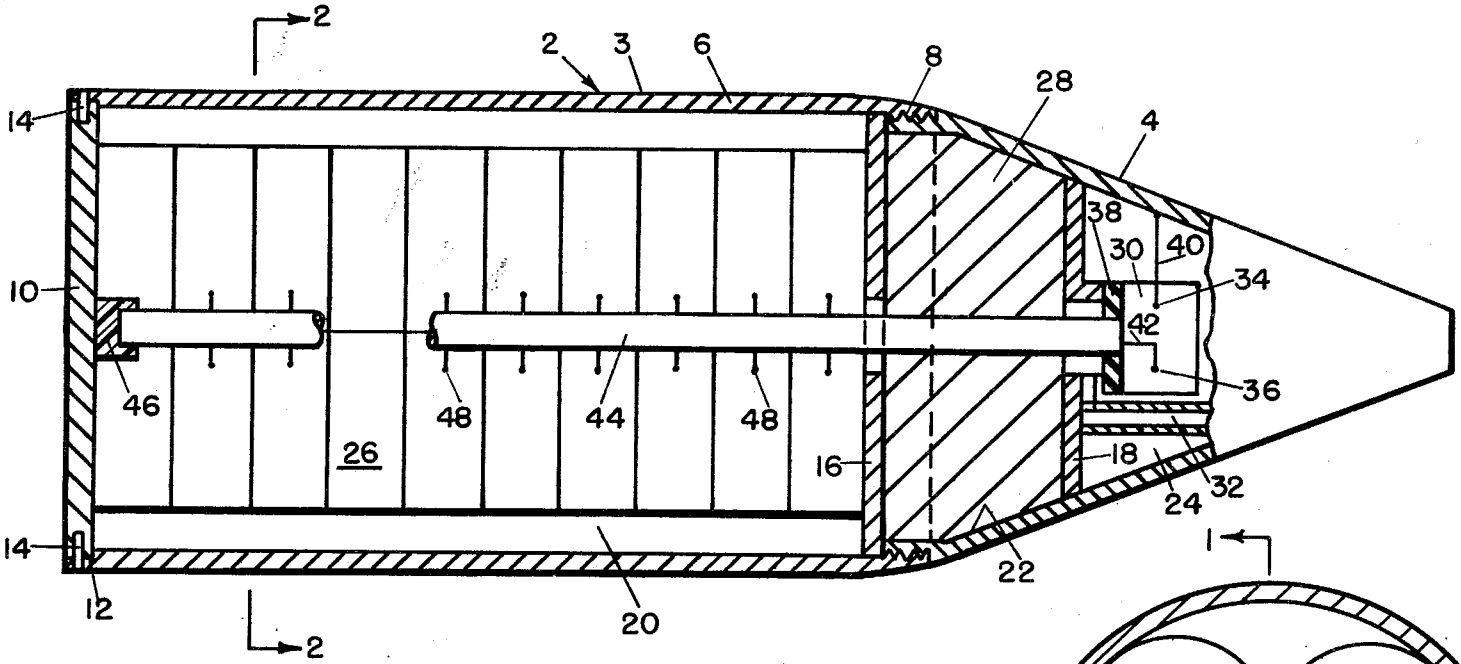
FIG. 1 is a longitudinal section view of an artillery shell embodying the invention.

Chamber 24 contains a battery 30 and a fuze (not shown) for igniting the propellant charge 28 at the desired time during flight, by means of a firing train including a flash passage 32 connecting the fuze primer with charge 28. The battery 30, which is schematically shown in FIG. 1 as a rectangle, has two terminals 34 and 36 and is insulatingly mounted on plate 18 by an insulating ring 38. One of the terminals, 34, is electrically connected by a conductor 40 to the ogive section 4 of the metal housing 3, and hence, to the outer metal wall 27 of each mine 26, which wall constitutes one side 50 of the self-destruct circuit 52 of each mine, shown in FIG. 3. The other terminal 36, is electrically connected by a conductor 42 to a metal rod or tube 44 which extends axially through the plates 16 and 18 to the base plate 10 where it is supported by an insulator 46. A break-away conductor 48, connected to rod 44, and extending in insulator relation through wall 27 of each of the mines 26, connects the rod 44 (and battery 30) to the other side 54 of each self-destruct circuit 52.

Figure 3:
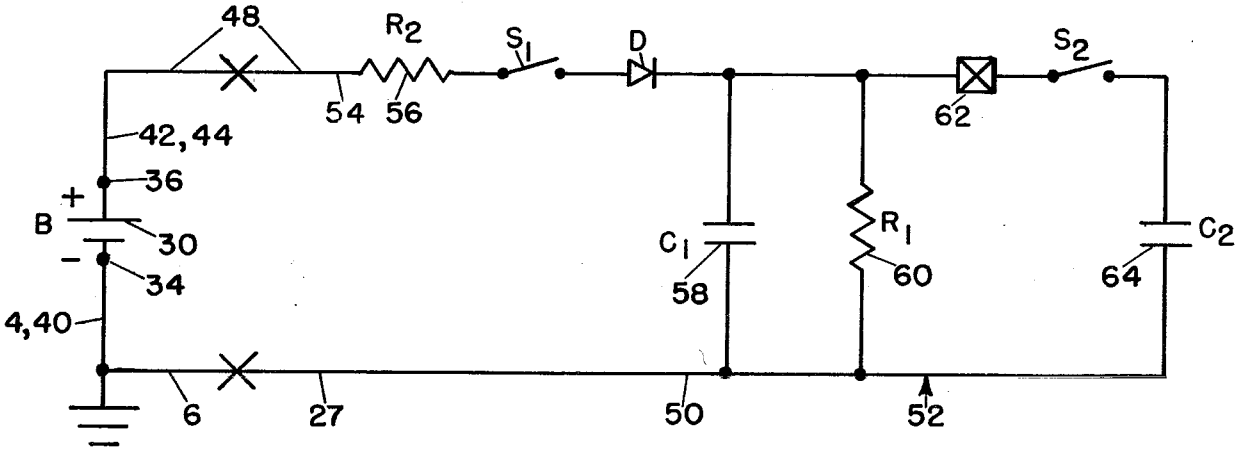
FIG. 3 is a circuit diagram of the self-destruct fuze of the present invention.

In the circuit of FIG. 3, the conductor 48 of one of the mines 26 is connected, through a current limiting resistor 56, a first switch $S_1$ and an optional blocking diode D, to one terminal of a timing capacitor 58, the other terminal of which is connected to the mine wall 27. A timing resistor 60 is connected in parallel with capacitor 58, to form an RC timing circuit. The connection between the diode D and capacitor 58 is connected through a mine detonator 62 and a second switch $S_2$, to one terminal of a second capacitor 64, the other terminal of which is connected to the other terminal of capacitor 58 (side 50). Thus, when switches $S_1$ and $S_2$ are closed, the capacitor 58, resistor 60 and capacitor 64 are all connected in parallel with the battery 30.

Figure 4:
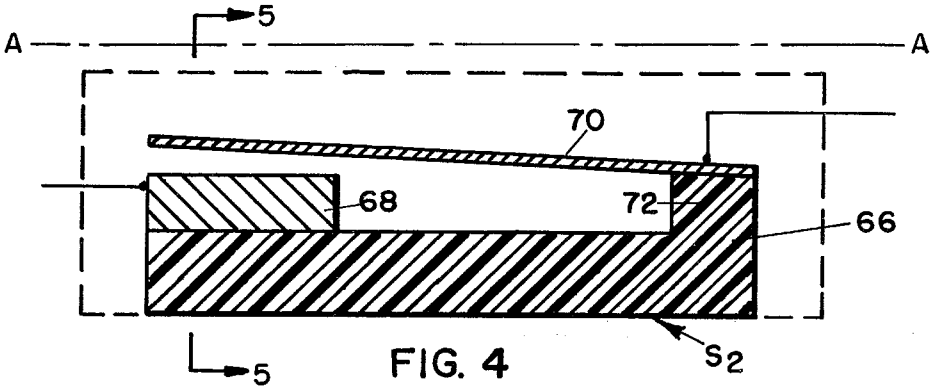
FIG. 4 is a longitudinal section view of an electrostatic switch that may be used in the present invention.
Figure 5:
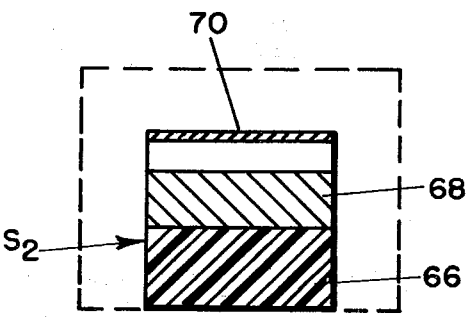
FIG. 5 is a transverse section view taken on line 5—5 of FIG. 4.

Switch $S_1$ is a conventional normally-open, spin-closed single-pole switch having a fixed contact and movable contact spring-pressed to open position and oriented in the mine so that it closes when the mine is spun with the spinning projectile during flight. The switch $S_2$ is a normally-open, spin-closed switch that is also voltage-responsive. For example, as shown in FIGS. 4 and 5, the switch $S_2$ may be an electrostatic switch comprising an insulator base 66, a large area fixed metal contact plate 68 attached to one end of base 66, and a resilient flexible or movable metal contact strip 70, such as a leaf spring, mounted at one end on an upward extension 72 of base 66 and having its other end adjacent to but normally spaced from the fixed contact plate 68, either by its own resilience or by a separate spring. The switch $S_2$ may be housed in a suitable container schematically illustrated by dashed lines in FIG. 4. The switch $S_2$ is mounted in the mine 26 with the movable contact strip 70 spaced from the spin axis A—A of the mine so that it will close the switch during spin and open it when the spin dies down. The battery 30 may be a primary battery which is fully charged when mounted in the projectile, or a storage battery which is charged after assembly of the projectile, by a separate lead-in (not shown) to the terminal 42. Such lead-in may also be used for measuring the battery voltage $V_o$ at any time before launch.

The operation of the self-destruct fuze is as follows. The fully-assembled projectile 2 is spin-launched from a gun barrel or other tubular launch tube having rifling means for spinning the projectile for stabilization purposes. Prior to launch, the two switches $S_1$ and $S_2$ are both open, and hence, the battery 30 is ineffective. After launch, the spin of the projectile 2 and each individual mine 26 causes both switches $S_1$ and $S_2$ to close, connecting the battery 30 in parallel with the capacitors 58 and 64 of each mine. The remainder of the description of the operation will be limited primarily to each mine, since each mine operates independently. When the switches close, the battery charges the two capacitors to a voltage $V_1$. Since the charging current passes through the detonator 62, the resistor 56 must have a resistance $R_2$ sufficient to limit the detonator current to a low value, insufficient to fire the detonator. For example, for a battery voltage $V_1$ of 180 volts, a resistance $R_2$ of 5 megohms limits the current to not more than 0.036 milliampere. With the battery polarity shown in FIG. 3, the diode D (if used) must be oriented as shown, to pass current therethrough. Since the resistance $R_2$ of resistor 56 is very low compared to the resistance $R_1$ of resistor 60 (for reasons which will be explained), the voltage drop across resistor 56 will be very small, and hence, the maximum voltage $V_1$ across the capacitor 58 will be substantially equal to the battery voltage $V_o$.

After being charged to the voltage $V_1$, the capacitors 58 and 64 retain their charges during further flight until the mines 26 are deployed from the projectile 2. At this time, the electrical connections 6–27 and 48 are broken, and each mine circuit 52 is isolated from the voltage source (30). However, the deployed mines 26 continue their spinning until each mine impacts the ground, and hence, the switch $S_2$ remains closed and the capacitors 58 and 64 remain fully charged. The switch $S_1$ also remains closed, and the diode D may be provided to prevent premature discharge of capacitors 58 and 64 in the event of a short occurring between the broken connectors 48 and the mine surfaces 27. As soon as each mine 27 stops spinning, both switches open. The opening of switch $S_2$ isolates the capacitor 64 and the RC circuit 58–60. The capacitor 58 begins to discharge through its resistor 60, while the capacitor 64 retains its charge (and voltage). As the capacitor 58 discharges, it loses voltage $\Delta V$ across resistor 60. This lost voltage $\Delta V$ appears across the open switch $S_2$. When $\Delta V$ reaches a voltage equal to the "switching voltage" $V_S$ of the voltage-responsive switch $S_2$, it causes that switch to close, suddenly discharging the voltage $V_S$ through the relatively low resistance detonator 62 and exploding the mine 26.

As pointed out above, it is desirable that the mine self-destruct about two days after deployment. This time depends upon the rate of discharge of the RC circuit described above from the initial voltage $V_1$ to a final voltage $V_2 = V_1 - V_S$. This time is $$t = R_1 C_1 \log_e \frac{V_1}{V_2},$$

where $C_1$ is the capacitance of capacitor 58, and $\log_e$ is the Naperian or natural logarithm. For an example in which $C_1 = 0.3\ \mu f\ (0.3 \times 10^{-6}$ farad),
$R_1 = 0.8 \times 10^{12}$ ohms,
$V_1 = 180$ volts,
$V_S = 85$ volts,
$V_2 = 95$ volts, the time $t$ is 153,360 seconds, or 42.6 hours. The resistance $R_1$ should be at least $10^{11}$ ohms, which is mandated by the desired 2 day ± 10% delay and considerations of sizes and costs of available high insulation capacitors. The above description ignores the effects of the leakage currents through the capacitors and the switch $S_2$ when open. For this approximation to be valid, the leakage resistances of the two capacitors should be at least $10 \times R_1$, or $10^{12}$ ohms, and the leakage resistance of the switch $S_2$ when open should be at least $100 \times R_1$, or $10^{13}$ ohms. The capacitance $C_2$ of the second capacitor 64 is not critical, and may, for example be $0.02 \times 10^{-6}\ \mu$f.

What is claimed is:

1. In a system comprising a projectile, adapted to be spin-launched and containing an explosive device adapted to be deployed from said projectile after launch thereof, a self-destruct fuze for exploding said explosive device at a predetermined time after deployment, said fuze comprising:

an electrical power supply carried by said projectile;

a first capacitor and a first resistor connected in parallel with each other and with a series assembly comprising a second capacitor, a normally-open spin-closed voltage-responsive first switch and an electrical detonator adapted to explode the device, carried by said device; and means for electrically connecting said power supply in series with: a normally-open spin-closed second switch; a second resistor, carried by said device; and said parallel connection, prior to deployment of the device from the projectile, and for disconnecting said power supply from the remainder of said fuze at said deployment; said second resistor having a resistance sufficient to limit the charging current through said detonator to a value insufficient to fire said detonator;

whereby: at launch, said two switches are closed by spin, connecting said power supply in parallel with said first resistor and said two capacitors, which are then charged to a voltage $V_1$, substantially equal to the power supply voltage $V_o$; at deployment of said device, said power supply is disconnected from the remainder of the circuit, and said switches open after spin ceases; and then, said first capacitor discharges through said first resistor to a voltage $V_2 = V_1 - V_S$, where $V_S$ is the switching voltage of said voltage-responsive switch, which then closes and discharges said voltage $V_S$ through said detonator to explode said device.

2. A fuze as in claim 1, wherein said series assembly also comprises a blocking diode.

3. A fuze as in claim 1, wherein the resistance $R_1$ of said first resistor is at least $10^{11}$ ohms, the leakage resistance of said capacitors is at least $10 \times R_1$, and the leakage resistance of said voltage-responsive switch when open is at least $100 \times R_1$.

4. A fuze as in claim 3, wherein $C = 0.3 \times 10^{-6}\ \mu f$ = capacitance of said first capacitor, $R_1 = 0.8 \times 10^{12}$ ohms = resistance of said first resistor, $V_1 = 180$ volts, $V_S = 85$ volts, $V_2 = 180 - 85 = 95$ volts, and the time $t$, required for said first capacitor to discharge to said voltage $V_2$, is $t = C_1R_1 \log_e V_1/V_2 = 153{,}360$ seconds $= 42.6$ hours.

5. A fuze as in claim 4, wherein the capacitance $C_2$ of said second capacitor is $0.02 \times 10^{-6}\ \mu f$, and the resistance $R_2$ of said second resistor is $5 \times 10^6$ ohms.

6. A fuze as in claim 1, wherein said voltage-responsive switch is an electrostatic switch comprising a fixed plate, a movable plate generally parallel with said fixed and movable into and out of contact therewith, and resilient means biasing said movable plate away from contact with said fixed plate; said movable plate being oriented in said explosive device in such manner as to be moved into contact with said fixed plate by centrifugal force when said device is spun.

7. In a system comprising a projectile, adapted to be spin-launched and containing a multiplicity of similarly-oriented explosive devices adapted to be deployed from said projectile after launch thereof, self-destruct fuze means for exploding each of said explosive devices at a predetermined time after deployment, said fuze means comprising:

an electrical power supply carried by said projectile;

a first capacitor and a first resistor connected in parallel with each other and with a series assembly of a second capacitor, a normally-open spin-closed voltage-responsive first switch and an electrical detonator adapted to explode the device, carried by each device; and means for electrically connecting said power supply in series with: a normally-open spin-closed second switch; a second resistor, carried by each device; and said parallel connection, prior to deployment of the device from the projectile, and for disconnecting said power supply from the remainder of said fuze means at said deployment; said second resistor having a resistance sufficient to limit the charging current through said detonator to a value insufficient to fire said detonator;

whereby: at launch, said two switches of each device are closed by spin, connecting said power supply in parallel with said first resistor and said two capacitors of each device, which are then charged to a voltage $V_1$, substantially equal to the power supply voltage; at deployment of each device, said power supply is disconnected from the remainder of the circuit of that device, and said switches open after spin ceases; and then, said first capacitor of each device discharges through said first resistor to a voltage $V_2 = V_1 - V_S$, where $V_S$ is the switching voltage of said voltage-responsive switch, which then closes and discharges said voltage $V_S$ through said detonator to explode said device.

8. Fuze means as in claim 7, wherein each of said series assemblies also comprises a blocking diode.

9. Fuze means as in claim 7, wherein the resistance $R_1$ of each first resistor is at least $10^{11}$ ohms, the leakage resistance of each capacitor is at least $10 \times R_1$, and the leakage resistance of each voltage-responsive switch is at least $100 \times R_1$.

10. Fuze means as in claim 9, wherein the capacitance $C_1$ of each first capacitor, the resistance $R_1$ of each first resistor, the switching voltage $V_S$ of each voltage-responsive switch, and the power supply voltage $V_1$ are chosen so that the time of said discharge of each first capacitor is about 2 days.

* * * * *